US009376826B2

(12) United States Patent
Hanson et al.

(10) Patent No.: US 9,376,826 B2
(45) Date of Patent: Jun. 28, 2016

(54) FORM SLEEVE FOR FORMING CONCRETE FOOTINGS

(75) Inventors: Ralph Hanson, East Hampton, MN (US); Glenn R. Collings, Burnsville, MN (US)

(73) Assignee: D & L Innovations, Inc., Hampton, MN (US)

( * ) Notice: Subject to any disclaimer, the term of this patent is extended or adjusted under 35 U.S.C. 154(b) by 758 days.

(21) Appl. No.: 13/486,433

(22) Filed: Jun. 1, 2012

(65) Prior Publication Data

US 2013/0037979 A1 Feb. 14, 2013

Related U.S. Application Data

(60) Provisional application No. 61/521,439, filed on Aug. 9, 2011.

(51) Int. Cl.

| | |
|---|---|
| ***E04G 13/02*** | (2006.01) |
| ***E02D 5/38*** | (2006.01) |
| ***E04C 3/34*** | (2006.01) |

(52) U.S. Cl.

CPC ..... *E04G 13/021* (2013.01); *E04C 3/34* (2013.01); *E02D 5/38* (2013.01)

(58) Field of Classification Search

CPC ..... E04G 13/02; E04G 13/021; E04G 13/023; E04G 13/025; E04G 13/026; E02D 5/38

USPC ..... 264/32; 52/741.14, 741.15; 249/48, 49, 249/51; 229/93, 122.33, 237, 108; 405/257

See application file for complete search history.

(56) References Cited

U.S. PATENT DOCUMENTS

| | | | | | |
|---|---|---|---|---|---|
| 1,138,558 | A | * | 5/1915 | Hamel | 249/48 |
| 1,698,931 | A | * | 1/1929 | Blaser | 24/116 R |
| 2,075,465 | A | * | 3/1937 | Powell | B65D 3/10 229/122.29 |
| 2,308,793 | A | * | 1/1943 | Upton | 405/216 |
| 3,024,512 | A | | 3/1962 | Dyer | |
| 3,115,292 | A | * | 12/1963 | Repking | B65D 5/14 229/110 |
| 3,166,871 | A | * | 1/1965 | Simison | 206/321 |
| 3,204,849 | A | * | 9/1965 | Vinney | B65D 5/14 206/807 |
| 3,338,058 | A | * | 8/1967 | Young | 405/223 |
| 3,348,738 | A | * | 10/1967 | Hertlein | 222/88 |
| 3,563,448 | A | * | 2/1971 | Croley | B65D 3/12 229/108 |
| 3,937,392 | A | * | 2/1976 | Swisher | B65D 5/12 220/320 |
| 3,972,454 | A | * | 8/1976 | Croley | 222/541.6 |

(Continued)

FOREIGN PATENT DOCUMENTS

| | | | | |
|---|---|---|---|---|
| EP | 595679 A1 | * | 5/1994 | E04G 13/02 |
| FR | 901288 | * | 7/1945 | E04G 13/02 |

(Continued)

*Primary Examiner* — Michael Safavi

(74) *Attorney, Agent, or Firm* — Schwegman Lundberg & Woessner, P.A.

(57) ABSTRACT

An example of a concrete form includes a sleeve with top edge and a bottom portion with a bottom edge generally parallel to the top edge. The bottom portion includes a plurality of bottom severance lines extending from the bottom edge to the top portion, and the top portion including a plurality of top creases extending from the top edge to the bottom portion. The top creases are generally perpendicular to the top and bottom edges. The top creases at least partially define a plurality of top panels around a periphery of the sleeve, and the bottom severance lines at least partially define a plurality of bottom panels configured to flare out when concrete is poured into the sleeve.

1 Claim, 14 Drawing Sheets

(56) References Cited

U.S. PATENT DOCUMENTS

| | | | | | |
|---|---|---|---|---|---|
| 4,013,168 | A * | 3/1977 | Bamburg | B65D 5/2033 | 108/55.1 |
| 4,089,417 | A * | 5/1978 | Osborne | B65D 19/20 | 108/56.1 |
| 4,094,455 | A * | 6/1978 | Bamburg | B65D 5/4804 | 229/120.37 |
| 4,166,567 | A * | 9/1979 | Beach, Jr. | B65D 5/18 | 229/108.1 |
| 4,648,220 | A * | 3/1987 | Gebelius | 52/155 | |
| 4,666,059 | A * | 5/1987 | Nordstrom | B65D 77/061 | 206/386 |
| 4,790,509 | A | 12/1988 | Cardwell et al. | | |
| 4,850,506 | A * | 7/1989 | Heaps, Jr. | B65D 77/061 | 206/386 |
| 5,328,142 | A * | 7/1994 | Weekers | 249/48 | |
| 5,390,464 | A * | 2/1995 | West | 52/741.1 | |
| 5,403,740 | A * | 4/1995 | Menefee | C05F 17/0205 | 229/117.01 |
| 5,551,662 | A | 9/1996 | Keady | | |
| 5,580,480 | A | 12/1996 | Chatelain | | |
| 5,785,459 | A | 7/1998 | Swinimer | | |
| 6,193,148 | B1 * | 2/2001 | Shimada | B65D 3/14 | 229/104 |
| 6,220,564 | B1 * | 4/2001 | Costello | 249/48 | |
| 6,578,814 | B2 | 6/2003 | Hoyle et al. | | |
| 6,840,491 | B2 | 1/2005 | Swinimer | | |
| 7,946,052 | B2 * | 5/2011 | Stevens | 33/645 | |
| 2004/0007657 | A1 * | 1/2004 | McEnroe, Jr. | 249/48 | |
| 2005/0066592 | A1 * | 3/2005 | Huber et al. | 52/169.9 | |
| 2006/0006216 | A1 * | 1/2006 | Moll | B65D 5/5445 | 229/235 |
| 2007/0235511 | A1 * | 10/2007 | Fitzwater | B65D 5/543 | 229/122.33 |
| 2013/0334296 | A1 * | 12/2013 | Bettinger | B65D 85/72 | 229/122.33 |

FOREIGN PATENT DOCUMENTS

| | | | | |
|---|---|---|---|---|
| FR | 1047860 | * | 12/1953 | E04G 13/02 |
| JP | 04124371 A | * | 4/1992 | E04G 13/02 |
| JP | 04285265 A | * | 10/1992 | E04G 13/02 |
| JP | 06158857 A | * | 6/1994 | E04G 13/02 |

* cited by examiner

FORM SLEEVE FOR FORMING CONCRETE FOOTINGS

RELATED APPLICATION

This application claims the priority benefit of U.S. Provisional Patent Application No. 61/521,439, filed Aug. 9, 2011, which is incorporated herein by reference in its entirety.

TECHNICAL FIELD

This application is related generally to construction tools and methods and, more particularly, to systems and methods for forming concrete footings.

BACKGROUND

Concrete footings distribute structural weight, allowing the soil to carry the load of the structure. Concrete footings are also used to provide a stable, level platform on which the structure is built. Concrete piers may be used as an upright support connecting a footing to a structural post above grade.

In climates susceptible to freezing temperatures, frost causes the ground to expand and move upward. Frost may adhere to concrete piers, moving the concrete piers as the frost moves. Thus, frost can adversely affect footings even if they extend below the frost line. Smooth concrete piers are less susceptible to frost heave. Additionally, concrete piers with a belled-out bottom portion help resist the upward forces from frost heave.

Concrete footings may be poured using footing forms, and the concrete piers may be formed on top of the footing forms. If using conventional footing forms, a wider hole is dug to allow the footing forms to be placed in the bottom of the hole. This wider hole is then backfilled after the pier is formed.

A poured concrete footing may combine the features of a pier and a footing by allowing the poured concrete to spread out at the bottom to form a bell pier. Bell piers have been used to provide footings for decks, for example. By way of example, it is known to provide a bell-shaped footing form at the bottom of the hole, and then provide a rigid construction tube on the bell-shaped footing form. Concrete can then be poured into the concrete tube and footing form at the same time. However, the use of such footing forms require that a wider hole be dug to allow the bell-shaped footing form to be placed in the bottom of the hole, and then backfilled after the bell pier is formed. It is also known to use only a cylindrical rigid construction tube to form a pier. The hole for the pier is dug with a diameter generally corresponding to the pier diameter. The bottom of the hole may be dug wider to provide room for the concrete to flow to form a bell for a bell pier. The tube is elevated off of the bottom of the hole to allow the poured concrete to fill the wider bottom of the hole and thus form the bell pier.

SUMMARY

An example of a concrete form includes a sleeve with top edge and a bottom portion with a bottom edge generally parallel to the top edge. The bottom portion includes a plurality of bottom severance lines extending from the bottom edge to the top portion, and the top portion including a plurality of top creases extending from the top edge to the bottom portion. The top creases are generally perpendicular to the top and bottom edges. The top creases at least partially define a plurality of top panels around a periphery of the sleeve, and the bottom severance lines at least partially define a plurality of bottom panels configured to flare out when concrete is poured into the sleeve.

An example of a kit to provide a form to create a concrete footing, includes a flattened sleeve and a collar. The flattened sleeve may be formed by a first blank of solid fiber. The first blank may have a generally rectilinear shape defined by a top edge, a bottom edge opposite the top edge, and opposite first and second lateral edges, where each of the first and second lateral edges extend between the top and bottom edges. The blank may include opposing first and second major sides corresponding to the generally rectilinear shape, and may have a bottom portion and a top portion. The bottom portion includes a plurality of bottom severance lines extending from the bottom edge to the top portion. The top portion includes at least two top creases extending from the top edge to the bottom portion, and generally parallel to the first and second lateral edges. The first blank includes a first margin proximate to the first lateral edge and a second margin proximate to the second lateral edge. The first margin and second margin are attached to form the sleeve. The top creases and bottom severance lines are configured to allow the sleeve to be flattened into the flattened sleeve. The collar is configured to fit over the sleeve after the sleeve is opened.

According to an example, a method of forming a concrete footing includes digging a hole for the concrete footing to a desired depth. The hole is dug with dimensions generally corresponding to a column of the concrete footing and a bottom of the hole is flared out for an expanded base of the concrete footing. The method may include opening a flattened sleeve into a shape of a concrete form, including flexing creases of the sleeve to provide an opened shape. The sleeve may include a bell portion with panels configured to flare out. The form may be inserted into the hole with the bell portion into the hole first. A collar may be placed over the form and secured in position above grade. The method may include filling the form with concrete, including forming the expanded base of the concrete footing when the panels of bell portion flare out at the bottom of the hole.

A concrete form example includes a sleeve having a top edge and a bottom edge generally parallel to the top edge where the top and bottom edges are in a lateral direction. The sleeve further has two or more parallel creases in a longitudinal direction, where the sleeve is configured to fold along at least two of the parallel creases to collapse into a flat profile, and the sleeve is configured to be opened from the flat profile into a tubular structure for the concrete form. The tubular structure is sufficiently rigid to allow the concrete form to be able to stand on end.

An example of a method for forming a concrete footing includes digging a hole for the concrete footing to a desired depth, wherein digging the hole includes digging the hole with dimensions generally corresponding to a column of the concrete footing. The method may further include opening a flattened sleeve into a concrete form with at least two panels that are sufficiently rigid to allow the concrete form to be able to stand on end. Opening may include flexing creases of the sleeve to provide an opened shape for the concrete form for use in forming the column of the concrete footing. The form may be inserted into the hole and filled with concrete.

This Summary is an overview of some of the teachings of the present application and is not intended to be an exclusive or exhaustive treatment of the present subject matter. Further details about the present subject matter are found in the detailed description and appended claims. The scope of the present invention is defined by the appended claims and their equivalents.

BRIEF DESCRIPTION OF THE DRAWINGS

Various embodiments are illustrated by way of example in the figures of the accompanying drawings. Such embodiments are demonstrative and not intended to be exhaustive or exclusive embodiments of the present subject matter.

DETAILED DESCRIPTION

The following detailed description of the present subject matter refers to the accompanying drawings which show, by way of illustration, specific aspects and embodiments in which the present subject matter may be practiced. These embodiments are described in sufficient detail to enable those skilled in the art to practice the present subject matter. Other embodiments may be utilized and structural, logical, and electrical changes may be made without departing from the scope of the present subject matter. References to "an," "one," or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

The present subject matter provides collapsible forms for pouring concrete. The forms have a flat profile before use and are therefore referred to herein as "flat-forms." The flat profile of the flat-forms during storage and transportation use much less space then conventional construction tubes that have a rigid cylindrical shape. Additionally, by way of example, the flat profile of the collapsed forms requires much less retail space than conventional construction tubes. By being designed to be folded or collapsed into a flat profile, the forms are easily stored and handled. The materials used for the forms allow the forms weigh significantly less than conventional forms or construction tubes. The flat-forms, according to the present subject matter, may be used to form footings for, by way of example and not limitation, decks, basketball hoops, fence posts, and guard posts.

Figure 1:
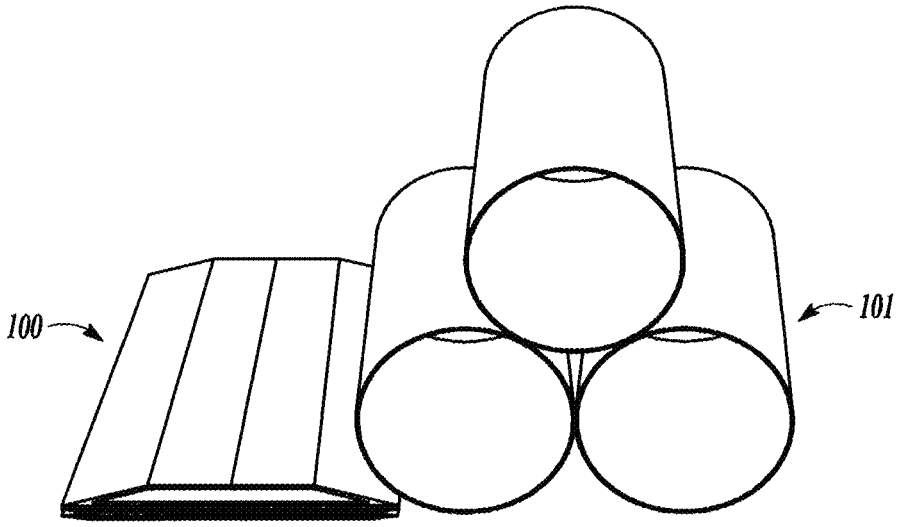
FIG. 1 illustrates, by way of example, a flat profile of collapsed flat-forms, according to various embodiments, along side of conventional construction tubes.

FIG. 1 illustrates, by way of example, a flat profile of collapsed flat-forms 100, according to various embodiments, along side of conventional construction tubes 1001. The figure illustrates the space-saving advantages of the flat-forms of the present subject matter. The three collapsed flat-forms 100 require much less space than the three conventional construction tubes 101 with a rigid cylindrical shape. The flat-forms are opened to create the concrete form. As discussed in more detail below, the flat-form may be braced with a forming collar and/or center support to hold concrete in place during the forming and setting process.

Figure 2:
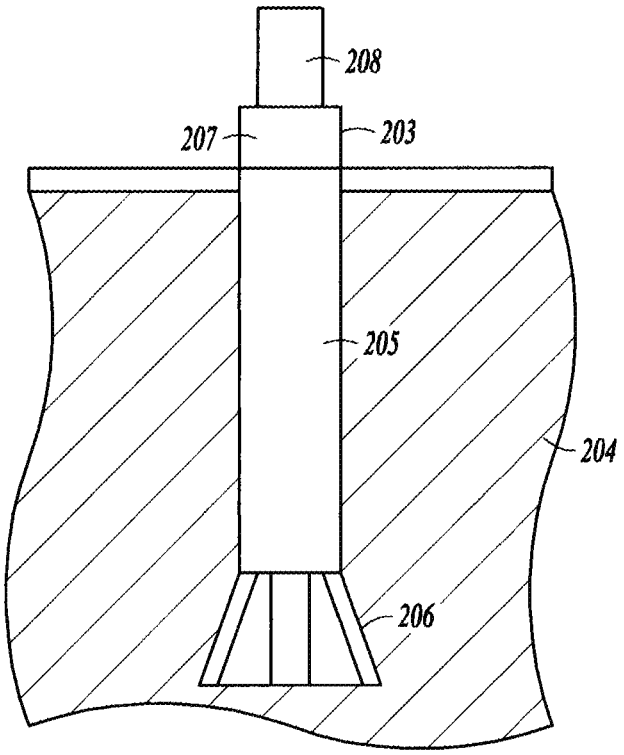
FIG. 2 illustrates, by way of example, a side view of a bell pier formed using an embodiment of a flat-form system.

FIG. 2 illustrates, by way of example, a side view of a bell pier formed using an embodiment of a flat-form system. The form allows the bell pier to be formed with minimal soil disturbance. Also, unlike a conventional construction tube, some flat-form embodiments are configured to allow the bottom of the form to flare out when concrete is poured, allowing the poured concrete to flow into a flared-out bottom of the hole to form the bell without elevating the form off of the bottom of the hole. A hole, with a flared out bottom, is dug into the ground 204, the opened flat-form 205 is positioned in the hole, and concrete is poured into the flat-form. The bottom 206 of the flat-form 205 also flares out when concrete is poured, thus allowing the poured concrete to fill the bottom of the hole and form the wider base or bell of the bell pier 203. The flat-form may extend and be supported above grade to allow the pier to also extend above grade. FIG. 2 illustrates exposed concrete 207 at the top of the pier, after the top portion of the flat-form is removed. The material used to manufacture the forms easily release from the cured concrete, such that they can be peeled away from the above-grade top portion of the pier. The portion of the flat-form below grade may remain between the concrete pier and the undisturbed soil. In some embodiments, the flat-form is manufactured from paper-based products, which are biodegradable. The figure also illustrates a portion of a post 208 for a structure attached to the top of the pier.

Figure 3:
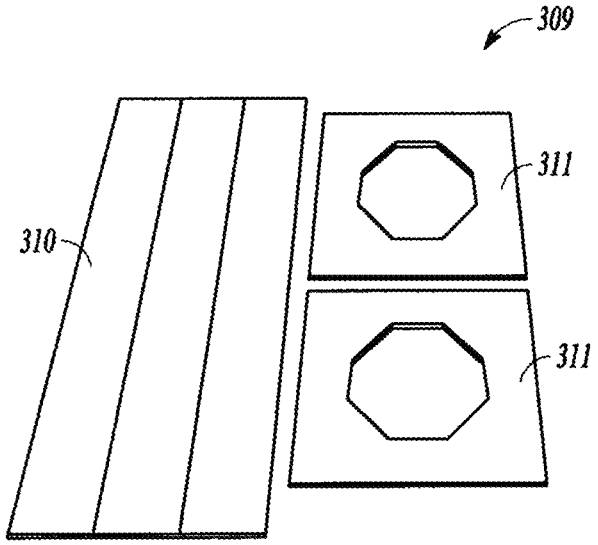
FIG. 3 illustrates, by way of example, an embodiment of a flat-form system including a folded or collapsed sleeve and forming collar(s).

FIG. 3 illustrates, by way of example, an embodiment of a flat-form system 309 including a folded or collapsed sleeve 310 and one or more forming collars 311. The forming collar(s) are designed to support the above-grade portion of the sleeve during the forming and setting of the concrete pier. The forming collar maintains the shape of the above-grade portion of the form. Also, the forming collar may be anchored to the ground to further stabilize the sleeve during the forming and setting of the concrete pier. For piers that extend above grade by only a short distance, a single forming collar may be placed around the sleeve.

Figure 4:
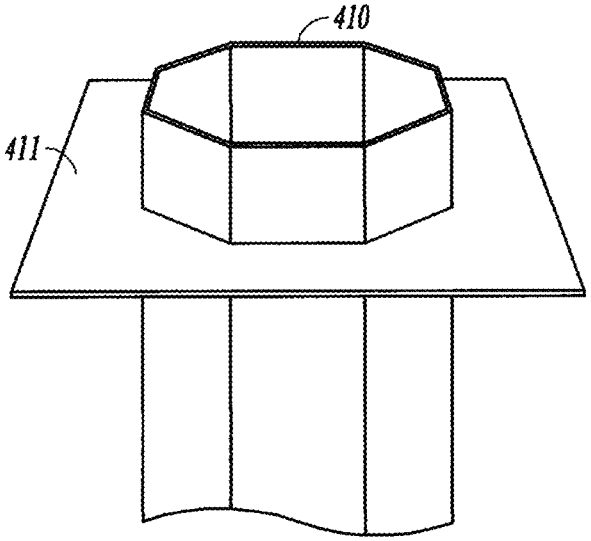
FIG. 4 illustrates the sleeve for the embodiment illustrated in FIG. 3 in an opened or expanded position, and a forming collar positioned over sleeve to engage an outer periphery of the sleeve and maintain the expanded sleeve in its desired shape.

The material of the sleeve 310 includes scores or creases where the material can bend to form edges of each of the straight sides. The material is strong enough to allow it to be formed into a multiple sided tube capable of supporting concrete or other similar materials during the forming and setting process. The material used to fabricate the multiple sided tube may be sufficiently rigid to allow the tube to be able to stand on end. Also, the material of the sleeve is capable of being cut by a utility knife, allowing the top of the sleeve corresponding to the portion of the pier above grade to be cut and peeled away from the pier. Thus, once the setting process is complete the form can be cut away from the formed material exposing the concrete product with the desired shape. In some embodiments, by way of example and not limitation, the sleeve is about 48 inches long with approximately ⅛ inch thick walls with a series of scores or creases formed along the length allowing it to be folded upon its self on two of the scores so it can lie flat. As is illustrated, the sleeve has a generally rectilinear shape. In the illustrated embodiment, the sleeve has a number of creases to form eight sides of equal widths to form an octagon cross-section. The forming collars 311 have a cut out or interior portion configured to fit around the open sleeve, as is generally illustrated in FIG. 4. Thus, in the illustrated embodiment, the forming collars have a cut out, also referred to as an interior portion, with eight edges that generally correspond to the eight sides of the opened form.

Figure 5:
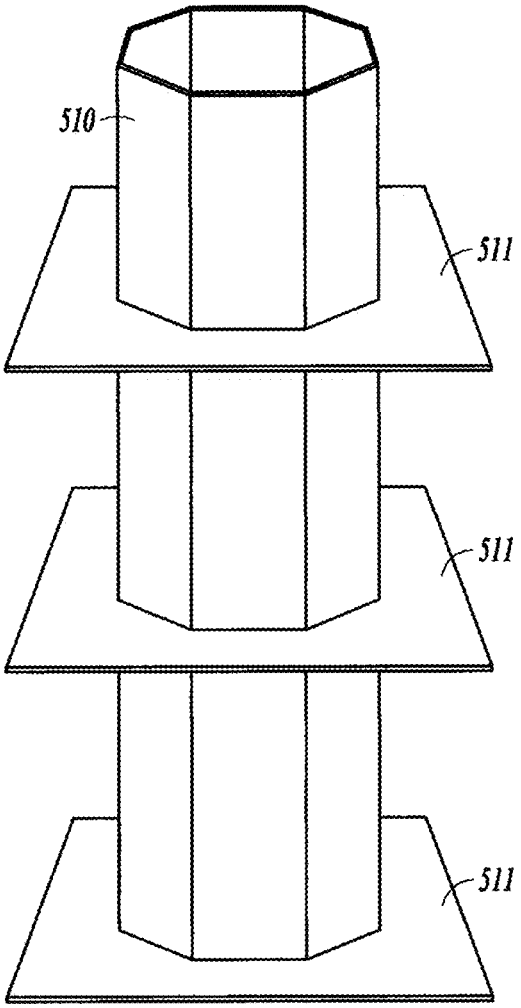
FIG. 5 illustrates, by way of example, an embodiment of a flat-form system with multiple forming collars used to stabilize an above-grade portion of the form.

FIG. 4 illustrates the sleeve 410 for the embodiment illustrated in FIG. 3 in an opened or expanded position, and a forming collar 411 positioned over sleeve to engage an outer periphery of the sleeve and maintain the expanded sleeve in its desired shape. Additional collars may be used if the piers extend greater distances above grade. FIG. 5 illustrates, by way of example, an embodiment of a flat-form system with multiple forming collars 511 used to stabilize an above-grade portion of the sleeve 510 used to form the concrete pier. Bracing material may be attached to the collar(s) using screws, wire, nails or other attachment means. The corners, by way of example, of the forming collars may be tied to stakes or other anchoring device to stabilize the form when the concrete is poured into the form and as the concrete cures.

Figure 6:
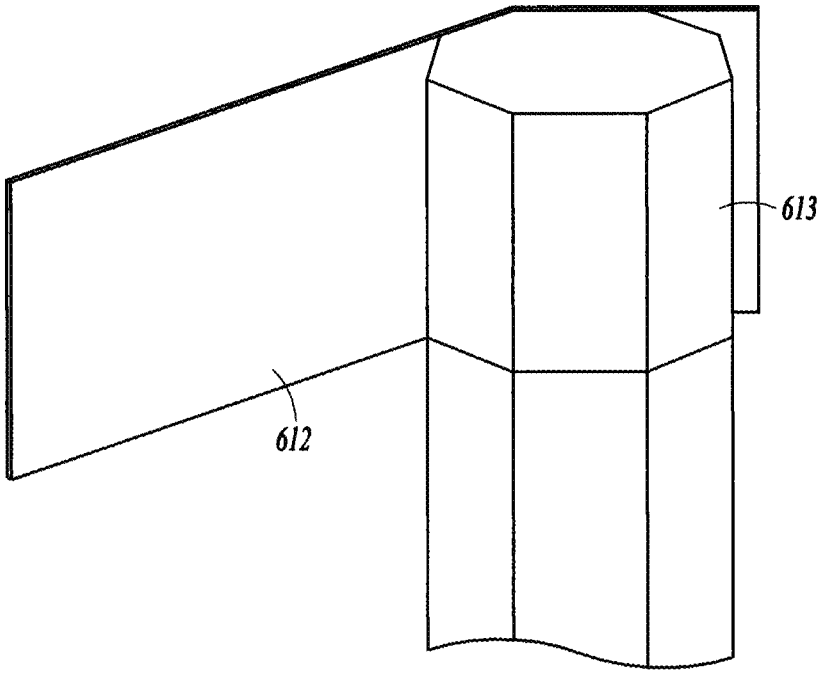
FIG. 6 illustrates, by way of example, an embodiment of a flat-form system after the concrete has cured, where a top portion of the sleeve is cut and partially striped away to illustrate the smooth concrete product and the ease in which the sleeve releases from the concrete.

FIG. 6 illustrates, by way of example, an embodiment of a flat-form system after the concrete has cured, where a top portion of the sleeve is cut and partially stripped away to illustrate the smooth concrete product and the ease in which the sleeve releases from the concrete. The material used to manufacture the forms easily release from the cured concrete, leaving a smooth side surface. By way of example and not limitation, the forms may be manufactured using solid-fiber, liner board or plastic, and the thickness of the sleeve wall is such that a utility knife is able to cut through the wall of the sleeve. The form could be made of other types of flexible material. Thus, the forms can be cut and peeled away, as generally illustrated at 612, from the above-grade top portion 613 of the formed concrete pier. For flat-form system embodiments manufactured using a biodegradable material, the surface of the pier below grade is also smooth. Thus, after the flat form biodegrades, a bell pier still has smooth surfaces that are less susceptible to frost heave then rougher surfaces.

Figure 7:
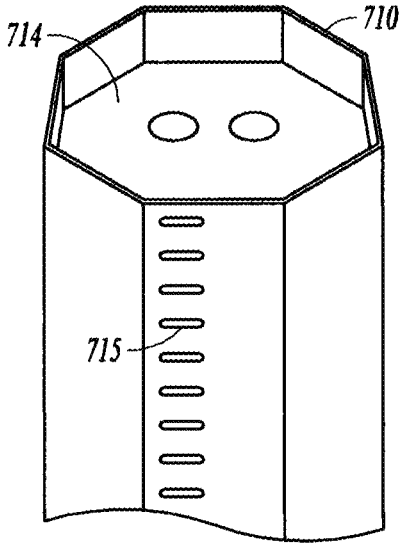
FIG. 7 illustrates, by way of example, an embodiment of a flat-form system with a center insert positioned within the expanded sleeve to hold the shape of the form during below grade uses, and also illustrating a stitched seam method of fastening material together to form the sleeve.

FIG. 7 illustrates, by way of example, an embodiment of a flat-form system with a center insert 714 positioned within the expanded sleeve 710 to hold the shape of the form during below grade uses, and also illustrating a stitched seam method 715 of fastening material together to form the sleeve. Other methods for attaching ends of material to form the sleeve may be used. For example, the two long edges may be overlapped and bonded together, by way of example, glue, staples, tape, welding, stitching, and the like. This allows it to be shaped into a tube when unfolded. When fully unfolded and opened from its flat profile, the sleeve may form a multiple sided tube. The form may be appropriately designed to provide other lengths, unfolded diameters, and the number scores or creases to define sides around the periphery of the sleeve. The form may be combined with another form to provide a longer form. For example, when stacking a form on top of another form, the bottom panels in the bottom portion may be tapered inward to be received in the top of another form. The bottom panels may be cut shorter to facilitate the stacking process and the subsequent formation of the concrete footing. Thus, by way of example and not limitation, if the forms are designed to provide about a 4 foot tall tube then tubes may be stacked together to form longer tubes (e.g. 5 or more feet). The stacked forms may be taped, stapled, or screwed or otherwise fastened together. This provides a solution to accommodate situations were the length of the bell pier should be longer. For example, this solution may accommodate locales where the frost is deeper, and thus the footings, are deeper. The combined forms may be cut to the desired height.

The center insert 714 is configured keep the form open during the bracing and filling process. The center insert 714 may be constructed of the same material used to construct the sleeve. The shape of the insert is cut or otherwise formed to cooperate with the interior of the opened sleeve to maintain the desired interior shape of the form. For example, for a system embodiment with an eight-sided sleeve, the center insert may be configured in the shape of an octagon to maintain the octagon shape. In another example, the center insert may be configured with a circular shape to transform the octagon shape of the sleeve into a round shape. The center insert is inserted during the unfolding process and prior to any filling of the form. The insert 714 drops to the bottom of the hole when concrete is poured into the form.

Figure 8:
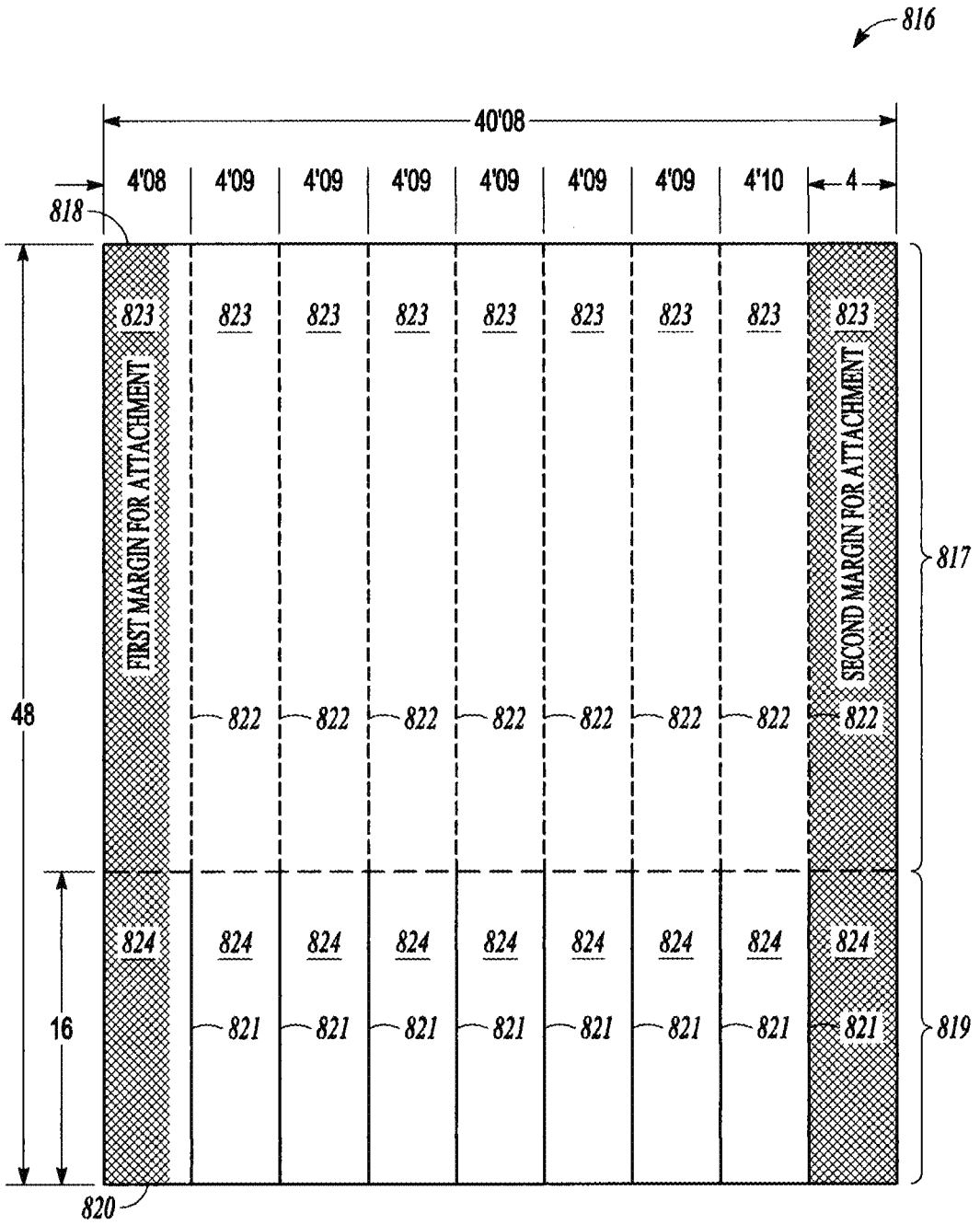
FIG. 8 illustrates, by way of example, a blank of material used to form a sleeve for an embodiment of a flat-form system.

FIG. 8 illustrates, by way of example, a blank of material (e.g. solid-fiber material) used to form a sleeve for an embodiment of a flat-form system. The illustrate blank 816 used to form the sleeve has a top portion 817 with a top edge 818 and a bottom portion 819 with a bottom edge 820 generally parallel to the top edge 818. The bottom portion 819 includes a plurality of bottom severance lines 821 extending from the bottom edge 820 to the top portion 817. The top portion 817 includes a plurality of top creases 822 extending from the top edge 818 to the bottom portion 819. The top creases 822 are generally perpendicular to the top and bottom edges 818 and 819. The top creases 822 at least partially define a plurality of top panels 823 around a periphery of the sleeve, and the bottom severance lines 821 at least partially define a plurality of bottom panels 824. These bottom panels 824 are configured to flare out when concrete is poured into the sleeve. In various embodiments, the plurality of the flat top panels 823 around the may have approximately equal widths. Thus, the cross-section of the formed sleeve may have the shape of a regular polygon. A regular polygon is a polygon whose sides are all the same length, and whose angles are all the same. The regular polygon may have an even number of sides to allow the sleeve to be folded flat. The left and right end panels may have other sizes, as these end panels are overlapped and attached together to form a seam for the sleeve. In various embodiments, the sleeve may include an even number of panels to allow the sleeve to be folded flat, using folding along at least two of the creases.

The severance lines 821 that at least partially define the plurality of bottom panels 824 in the sleeve may include full cuts through the blank (a wall of the sleeve) that allow the bottom panels to flare out when concrete is poured into the sleeve. The severance lines that define the plurality of bottom panels in the sleeve may include partial cuts through the blank (the wall of the sleeve) that allow adjacent bottom panels in the sleeve to be severed along the partial cuts, allowing the bottom panels flare out when concrete is poured into the sleeve. The severance lines that define the plurality of bottom panels in the sleeve may include score lines in the blank (e.g. the wall of the sleeve that allow adjacent bottom panels in the sleeve to be severed along the score lines, allowing the bottom panels flare out when concrete is poured into the sleeve. The severance lines that define the plurality of bottom panels in the sleeve may include perforations through the blank (e.g. the wall of the sleeve) that allow adjacent bottom panels in the sleeve to be severed along the perforations, allowing the bottom panels flare out when concrete is poured into the sleeve. The illustrated blank 816 includes a boundary crease line 825 at an interface between the top portion 817 and the bottom portion 819. The boundary crease line 825 is generally parallel to the top and bottom edges 818 and 820 of the rectilinear blank.

The illustrated blank includes dimensions for a concrete pier that may be used to construct a deck. These measurements are provided as an example, and are not intended to be limiting. The length of the blank, and thus the height of the sleeve in this embodiment is about 48 inches. The bottom portion, configured to flare out to form the bell, extends about 16 inches from the bottom of the blank. The width of the blank is about 40 and 8/16 inches, and the width of each panel is about 4 and 9/16 inches or 4 and 10/16 inches. The end panels that are overlapped and connected together are illustrated at 4 and 916 inches and 4 inches. The overlapped portion can be formed to provide one side of the regular polygon cross-section. One of ordinary skill in the art will understand, upon reading and comprehending this disclosure, how to modify these dimensions to provide piers of other dimensions.

According to some embodiments, the flat-forms are constructed of a material and with such dimensions that allow the material to be easily cut using a utility knife, for example. Thus, the tube can be easily cut to shorten the length of the tube to a desired length. The sleeve may be formed from a variety of material. Some desirable characteristics of the material are that it is relatively lightweight, flexible, and smooth. Smooth material does not allow frost to grab onto the footing surface as readily thereby providing a more stable footing. The material is generally water resistant, at least for a time period until the poured concrete cures (e.g. several hours to a day). Although some moisture may permeate through the form, the material used to create the form should prevent most moisture from permeating through the material. In some embodiments, the material may also be at least partially biodegradable over longer periods of time.

In various embodiments, the material used is solid fiber. Solid fiber is manufactured by using layers of linerboard glued together with water resistant adhesive. The linerboard may include Kraft paper. By way of example and not limitation, 56 pt or 70 pt linerboard may be used depending on the particular design requirements. The sleeve is formed using two or more liner boards adhered together using a water resistant glue. By way of example and not limitation, some embodiments may use four layers laminated together. However, more or fewer layers may be used in other embodiments. Some embodiments use corrugated plastic.

Figure 9:
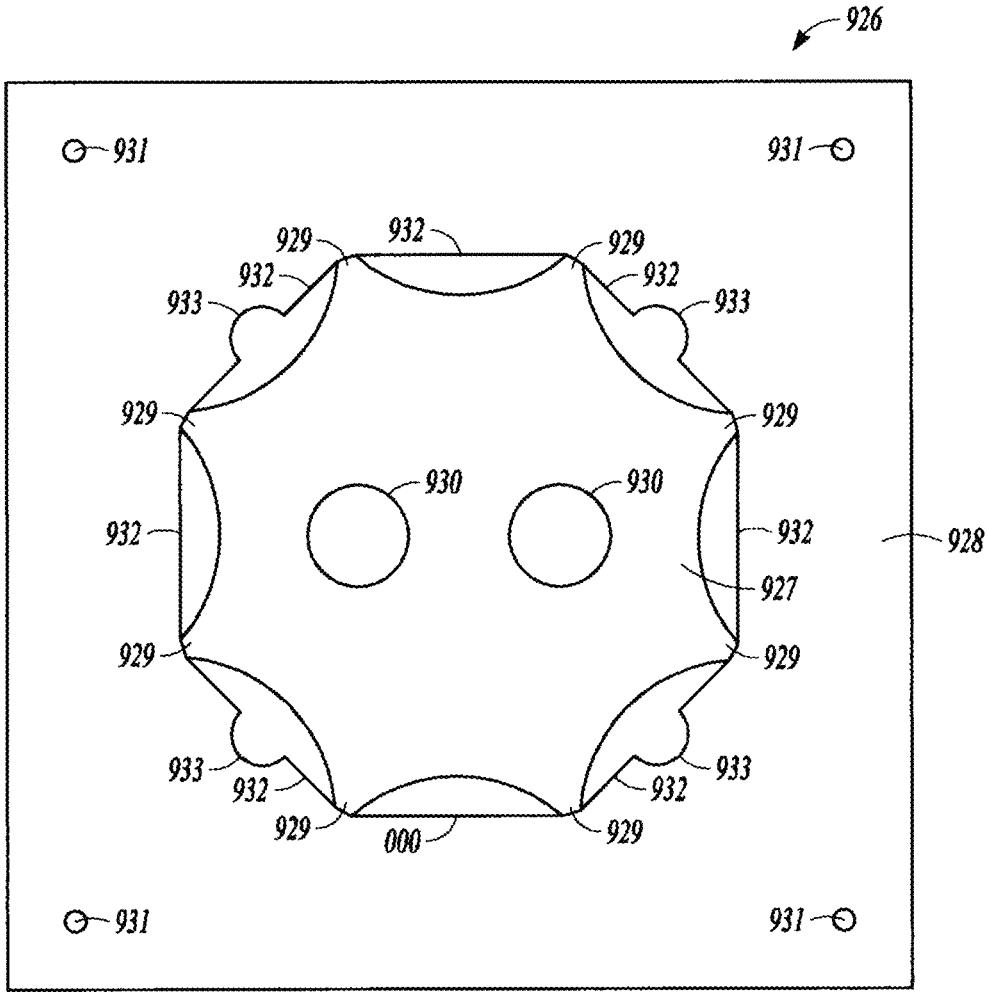
FIG. 9 illustrates, by way of example, a blank of solid material used to form a center insert and a forming collar for an embodiment of a flat-form system.

FIG. 9 illustrates, by way of example, a blank of material 926 (e.g. solid fiber material) used to form a center insert 927 and a forming collar 928 for an embodiment of a flat-form system. The insert 927 is configured to be positioned in the sleeve and maintain the sleeve in an open position before concrete is formed into the sleeve. In some embodiments, the insert may include a plurality of vertices 929 corresponding to the plurality of top creases in the top portion of the sleeve. The illustrated insert 927 also include holes 930 through which fingers may be inserted when positioning the insert in the sleeve. The collar 928 is configured to be positioned around an exterior perimeter of the sleeve and to support the sleeve above grade. The collar may be staked above grade to support the sleeve within the collar. The illustrated collar includes four apertures 931, which may be used to tie the collar 928 to anchors, such as landscape stakes, to support the above-grade portion of the form. The illustrated collar 928 includes an interior shape corresponding to the periphery of the sleeve, and is configured to maintain the shape of the sleeve after concrete is poured into the sleeve. For example, the interior shape of the collar 928 includes edges 932 that correspond to the width of the top panels in the sleeve. The interior shape of the collar may also include spaces 933 useful when positioning the collar around the sleeve.

An embodiment of the present subject matter provides a kit to provide a form to create a concrete footing. The kit may include a flattened sleeve (e.g. FIG. 3 at 310) formed by a first blank (e.g. FIG. 8 at 816) of solid fiber and a collar (e.g. FIG. 3 at 311) configured to fit over the sleeve after the sleeve is opened (e.g. FIG. 4). The first blank has a generally rectilinear shape defined by a top edge 818, a bottom edge 820 opposite the top edge, and opposite first and second lateral edges, each of the first and second lateral edges extending between the top and bottom edges, the blank including opposing first and second major sides corresponding to the generally rectlinear shape. The blank has a bottom portion 819 and a top portion 817. The bottom portion includes a plurality of bottom severance lines 821 extending from the bottom edge 820 to the top portion 817. In some embodiments, the severance lines include full cuts through the blank. In some embodiments, the severance lines include partial cuts through the blank. In some embodiments, the severance lines include score lines in the blank that allow adjacent bottom panels. In some embodiments, the severance lines include perforations in the blank. The top portion 817 includes a plurality of top creases 822 extending from the top edge 818 to the bottom portion 819. The top creases are generally parallel to the first and second lateral edges. The first blank includes a first margin proximate to the first lateral edge and a second margin proximate to the second lateral edge. The first margin and second margin are attached to form the sleeve. The second major surface (e.g. back) of the blank for one margin may be attached to the first major surface (e.g. front) of the blank for the other margin, allowing the blank to form a tubular structure. The top creases and bottom severance lines are configured to allow the sleeve to be flattened into the flattened sleeve. By way of example, an even number of equally spaced top creases allow the blank to be folded along two of the creases (opposite creases in the sleeve) into a flat profile. In some embodiments, the kit may further comprise an insert (e.g. FIG. 9 at 927) configured to fit inside the opened sleeve. In some embodiments, the insert 927 and the collar 928 may be formed by a second blank 926 of solid fiber, where the second blank has a generally rectilinear shape with an inner portion providing the insert and an outer portion providing the collar. The support collar maintains the intended shape of the form during the forming and setting process and facilitates the vertical bracing process by allowing easier attachment of bracing material to collar by screws, wire, nails or other methods. The collar is made of corrugated or solid fiber material and has the desired shape of the form cut into it so that when slipped onto the form, the collar holds the form in the desired shape during the pouring and setting process. More than one collar can be used depending on the degree of support needed. The collar can also be used to help hold the form in an upright position during the pouring and setting process by any of various bracing methods attached to the collar.

The kit may be formed using a method that includes forming a flattened sleeve using a first blank of solid fiber. The first blank has a generally rectilinear shape defined by a top edge, a bottom edge opposite the top edge, and opposite first and second lateral edges, each of the first and second lateral edges extending between the top and bottom edges, the blank including opposing first and second major sides corresponding to the generally rectlinear shape. The blank has a bottom portion and a top portion. Forming the flattened sleeve may include forming a plurality of perforated bottom cuts extending from the bottom edge to the top portion. Forming the top portion may include a plurality of top creases extending from the top edge to the bottom portion, the top creases are generally parallel to the first and second lateral edges. The first margin is attached proximate to the first lateral edge to a second margin proximate to the second lateral edge to form the sleeve. Flattening the sleeve may include folding at least two top creases to form the flattened sleeve. For example, two opposite creases of the sleeve may be folded to flatten the sleeve. Forming the kit may further include, by way of example, forming a collar and an insert from a second blank. For example, the second blank may be cut to form the collar and the insert within the collar.

Upon reading and understanding this document, those of ordinary skill in the art will appreciate that the flat-form may be made in various lengths and diameters. Additionally, the flat form may be made with various numbers of creases and/and severance lines. Thus, the flat-form may be designed for use to form piers of various heights, widths, and cross-sectional widths. The diameter of the sleeve of the sleeve may be adjusted by changing the position of the overlapped and bonded seam. The collar could be made in various shapes and sizes along with the various sizes of forms and made of many different types of flat stock type material.

Figure 10:
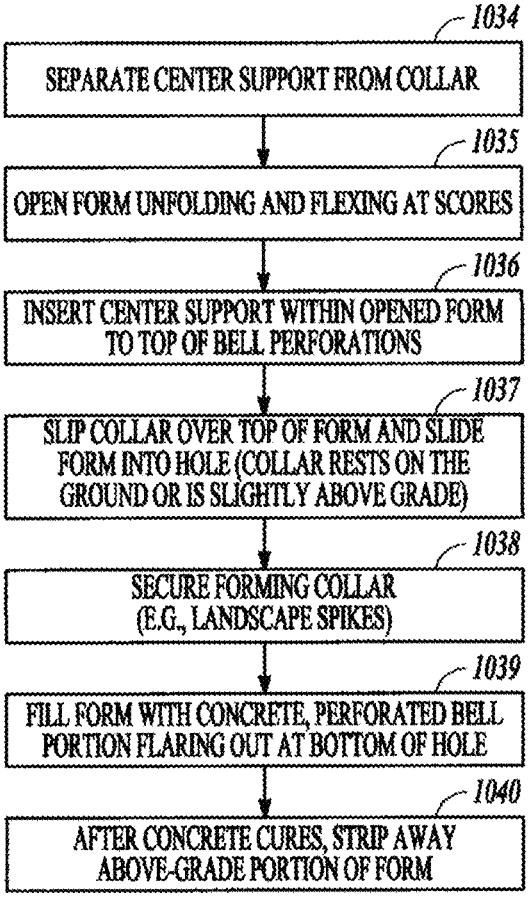
FIG. 10 illustrates, by way of example, a flow diagram for using a flat-form system to form a bell pier.
Figure 11A:
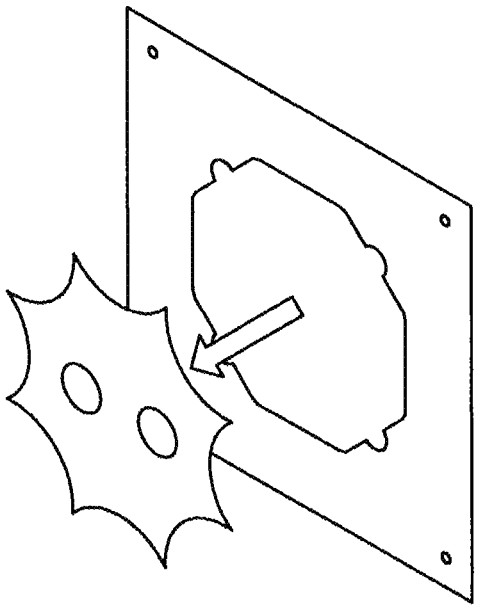
FIGS. 11A-11F illustrate portions of the process for forming the bell pier.
Figure 11B:
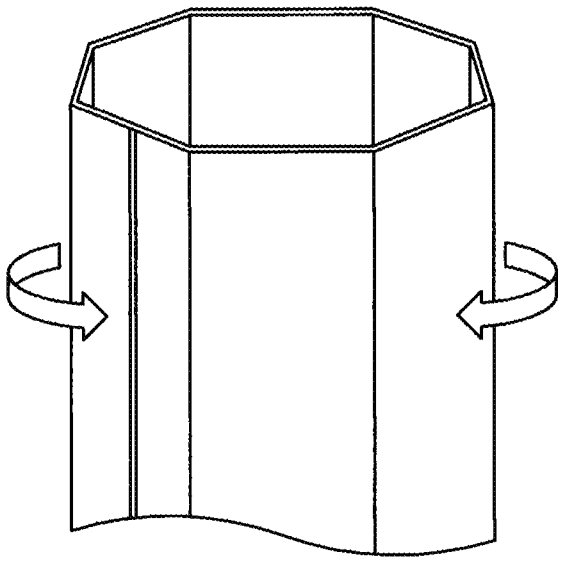
Figure 11C:
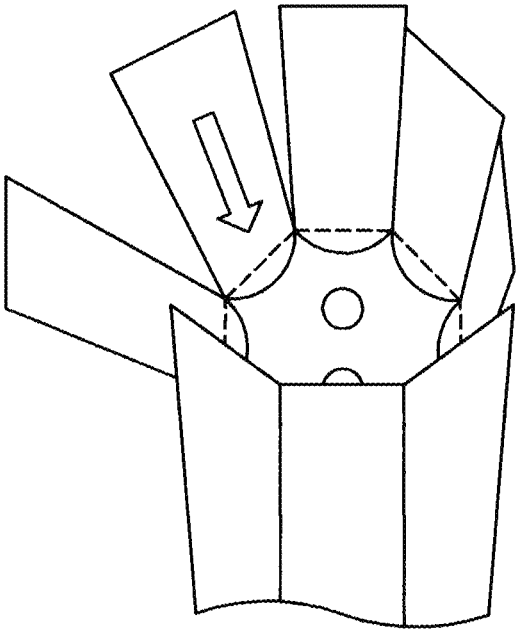
Figure 11D:
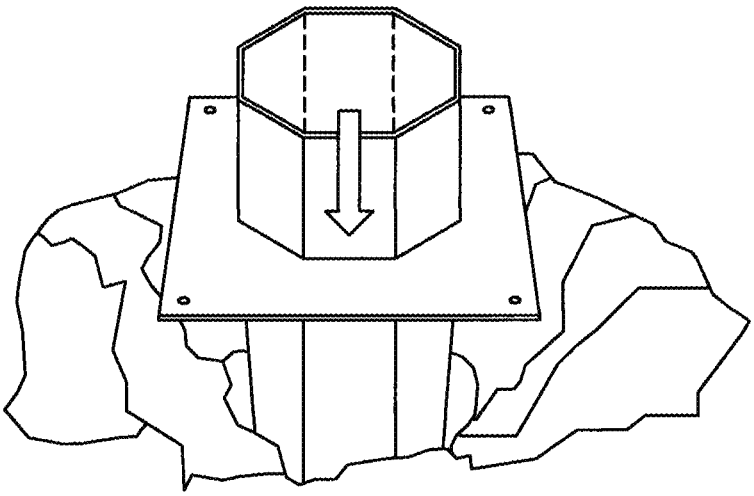
Figure 11E:
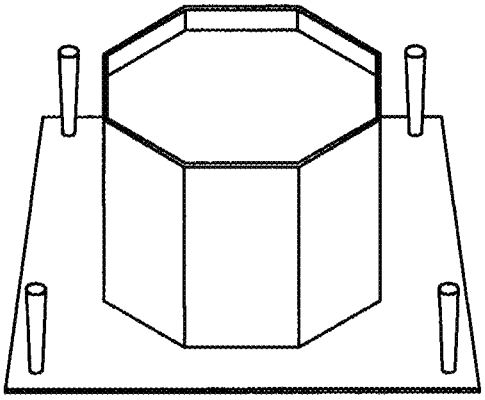
Figure 11F:
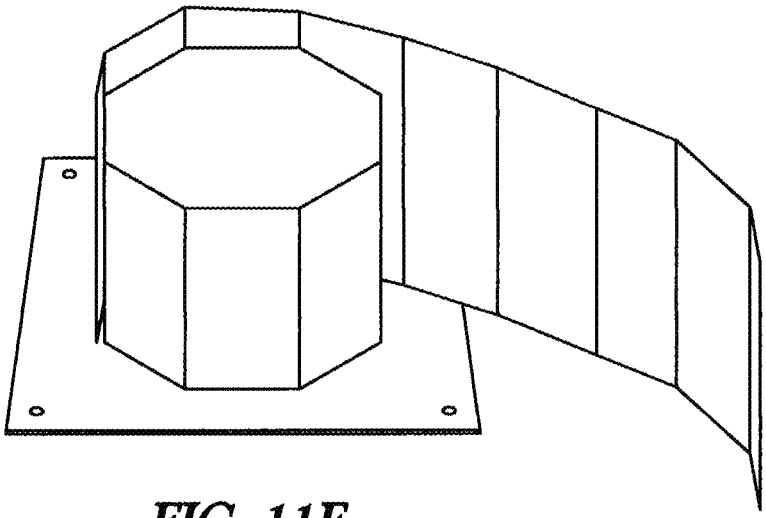

FIG. 10 illustrates, by way of example, a flow diagram for using a flat-form system to form a bell pier, and FIGS. 11A-11F illustrate portions of the process for forming the bell pier. For embodiments where the center insert is formed inside of the collar (e.g. FIG. 11A), the center support, also referred to as a center insert, may be removed 1034. The flat-form may be unfolded into an open position, flexing it on each of its scores 1035 (e.g. FIG. 11B). The center support may be inserted to or near the top of the bell perforations 1036, i.e. between the top and bottom portions of the sleeve (e.g. FIG. 11C). The forming and bracing collar may be slipped onto the form and the form may be positioned as desired 1037 (e.g. FIG. 11D). The collar may rest on or be above grade. The collar may be secured using landscape spikes or various other bracing methods 1038 (e.g. FIG. 11E). The collar also enables easier cleanup, as splashed concrete or overflows fall on the collar that surrounds the form. The form is filled with concrete or other desired material 1039. For embodiments with a bottom portion configured to flare out to form a bell pier, the weight of the concrete causes the bottom of the flat form to flare out, allowing the concrete to fill the bottom of the hole and form the bell. After the proper setting time has elapsed the form can be cut away from the formed material 1040 (e.g. FIG. 11F).

The process form forming the pier may include more or less steps than shown in FIGS. 10 and 11A-11F. For example, some embodiments may not need to have a center insert installed within the sleeve. For example, if the form is above grade, it may not be necessary to use a center insert. By way of another example, if the form is below grade, such that the top of the pier is at or near grade, then the forming collar may not need to be used. For flat-form embodiments with out the bottom portion configured to flare out to form an expanded footing for a bell pier, the process may involve raising the form to allow concrete to flow outward to form an expanded footing for a bell pier.

The flat sides of the form may be maintained, via a forming collar discussed below, while the concrete is poured and cured. Thus, for embodiments where the form has an octagon shape and the interior of the forming collar also has an octagon shape corresponding to an exterior periphery of the form, the forming collar maintains the top of the pier with the octagon shape. The flat-forms may be designed with different number of sides. The forming collar may be configured to allow the weight of the concrete to convert the shape of the top portion of the pier. For example, a forming collar with a circular interior allows the weight of the concrete to push out on the form to form the circular shape at the top of the pier. In another example, a forming collar with a square interior may allow the weight of the poured concrete to push out on the form to transform the shape from an octagon to a square shape.

Various flat-form embodiments are discussed below, and are generally illustrated in FIGS. 12A-12D, 13A-13E, 14A-14E, and 15A-15E. These figures generally illustrate the flattened sleeve along with the creases or folds of the sleeve, and further illustrate the cross-sectional shape of the opened sleeve. These illustrations do not include a bottom portion with the severance lines to form bottom panels that flare out to form the belled pier. These illustrated embodiments may either include or not include such severance lines. Embodiments that do not include a bottom configured to flare out may be used to form piers without a belled bottom portion, or may be used to form a belled bottom portion by raising the form to allow concrete to flow out similar to how a rigid construction tube is used. Additionally, embodiments without a bottom configured to flare out may be cut at the job site to form the bottom panels, allowing the poured concrete to flare out the bottom portion of the flat form.

Figure 12A:
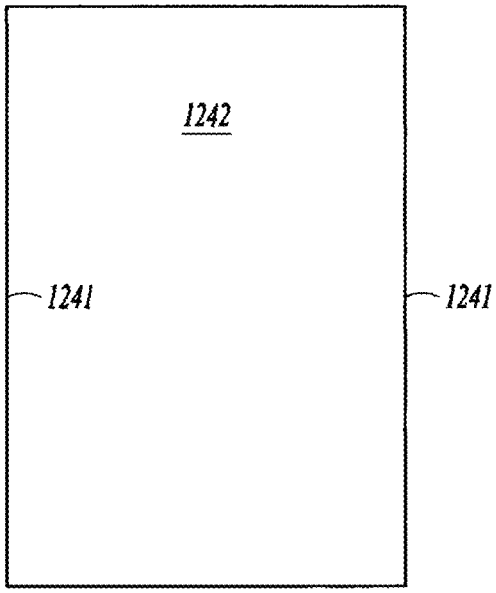
FIGS. 12A-12D illustrate, by way of example, an embodiment of a flat-form system with a sleeve formed with two panels.
Figure 12B:
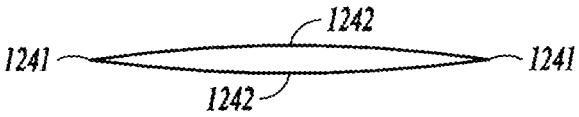
Figure 12C:
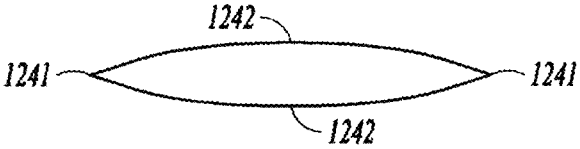
Figure 12D:
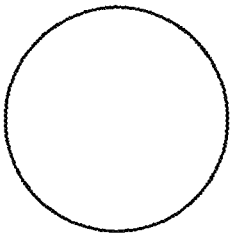

FIGS. 12A-12D illustrate, by way of example, an embodiment of a flat-form system with a sleeve formed with two panels. FIG. 12A illustrates a top view of the flattened sleeve folded at two crease lines 1241, FIG. 12B is an end view illustrating the flat profile of the sleeve, including the two panels 1242. FIG. 12C illustrates the sleeve as it is opened up. The panels 1242 are flexible and thus will bend even without additional crease lines. The weight of the poured concrete pushes outward in all directions. Some embodiments are designed to allow this force to transform the flat form into a form with a circular or near circular cross-section as is generally illustrated in FIG. 12D. A forming collar with a corresponding circular interior portion may be used to support the flat-form above grade and create a round pillar.

Figure 13A:
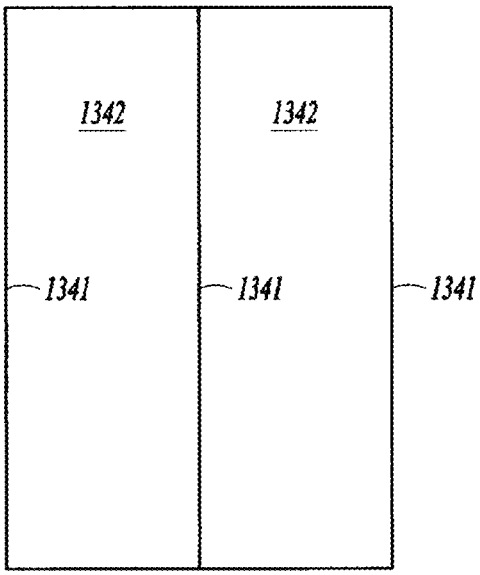
FIGS. 13A-13E illustrate, by way of example, an embodiment of a flat-form system with a sleeve formed with four panels.
Figure 13B:
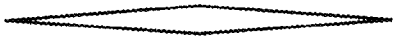
Figure 13C:
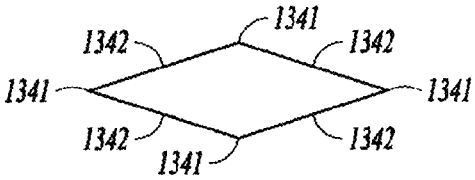
Figure 13D:
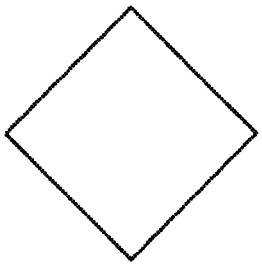
Figure 13E:
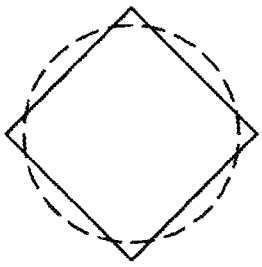

FIGS. 13A-13E illustrate, by way of example, an embodiment of a flat-form system with a sleeve formed with four panels. FIG. 13A illustrates a top view of the flattened sleeve folded at two of the four crease lines 1341. FIG. 13B is an end view illustrating the flat profile of the sleeve. FIG. 13C illustrates the sleeve as it is opened up, including the crease lines 1341 and panels 1342. The panels 1342 are flexible and thus will bend even without additional crease lines. The weight of the poured concrete pushes outward in all directions. For various embodiments, this force may be sufficient cause the flat form to have a circular cross-section. A forming collar may be configured with an interior portion with four edges to maintain the square shape above grade, as illustrated in FIG. 13D. A forming collar with a corresponding circular interior portion may be used to support the flat-form above grade, and allow the flat-form to be be transformed from a square shape into a round shape under the weight of the poured concrete, as generally illustrated in FIG. 13E.

Figure 14A:
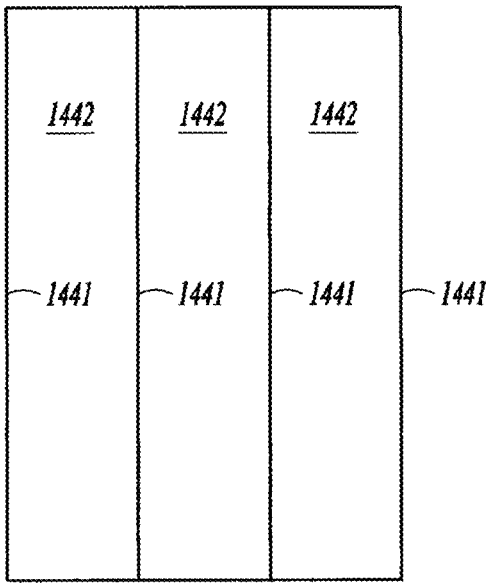
FIGS. 14A-14E illustrate, by way of example, an embodiment of a flat-form system with a sleeve formed with six panels.
Figure 14B:
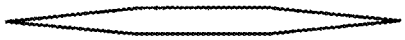
Figure 14C:
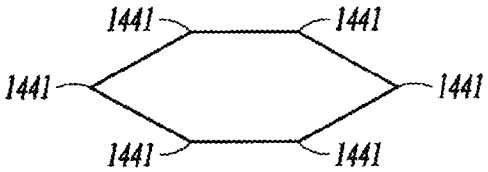
Figure 14D:
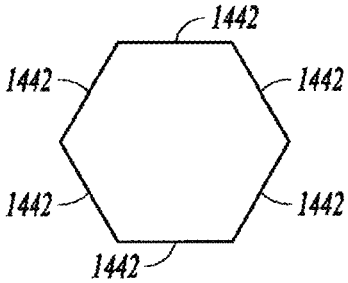
Figure 14E:
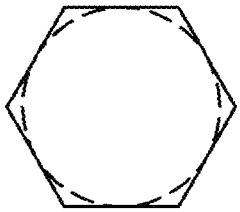

FIGS. 14A-14E illustrate, by way of example, an embodiment of a flat-form system with a sleeve formed with six panels. FIG. 14A illustrates a top view of the flattened sleeve folded at two of the six crease lines 1441. FIG. 14B is an end view illustrating the flat profile of the sleeve. FIG. 14C illustrates the sleeve as it is opened up, including the six crease lines 1441 and the panels between the crease lines. The panels are flexible and thus will bend even without additional crease lines. The weight of the poured concrete pushes outward in all directions. For various embodiments, this force may be sufficient cause the flat form to have a circular cross-section. A forming collar may be configured with an interior portion with six edges to maintain the hexagon shape above grade, as illustrated in FIG. 14D. A forming collar with a corresponding circular interior portion may be used to support the flat-form above grade, and allow the flat-form to be be transformed from a hexagon shape into a round shape under the weight of the poured concrete, as generally illustrated in FIG. 14E.

Figure 15A:
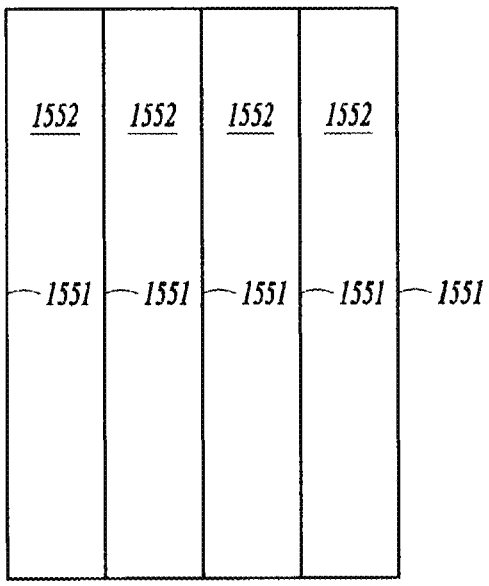
FIGS. 15A-15E illustrate, by way of example, an embodiment of a flat-form system with a sleeve formed with eight panels.
Figure 15B:
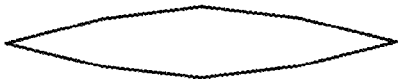
Figure 15C:
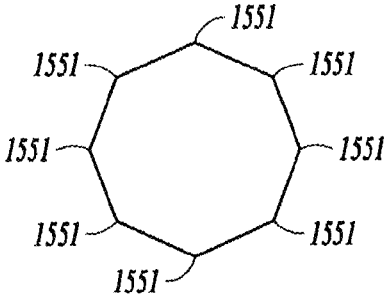
Figure 15D:
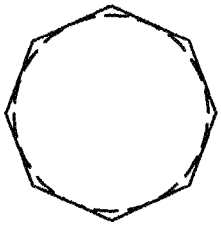
Figure 15E:
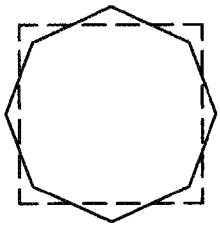

FIGS. 15A-15E illustrate, by way of example, an embodiment of a flat-form system with a sleeve formed with eight panels. FIG. 15A illustrates a top view of the flattened sleeve folded at two of the eight crease lines 1541. FIG. 15B is an end view illustrating the flat profile of the sleeve. FIG. 15C illustrates the sleeve as it is opened up, including the eight crease lines 1541 and the panels between the crease lines. The panels are flexible and thus will bend even without additional crease lines. The weight of the poured concrete pushes outward in all directions. For various embodiments, this force may be sufficient cause the flat form to have a circular cross-section. A forming collar may be configured with an interior portion with eight edges to maintain the octagon shape above grade, as illustrated in FIG. 15C. A forming collar with a corresponding circular interior portion may be used to support the flat-form above grade, and allow the flat-form to be be transformed from a octagon shape into a round shape under the weight of the poured concrete, as generally illustrated in FIG. 15D. A forming collar with a corresponding square interior portion may be used to support the flat-form above grade, and allow the flat-form to be be transformed from a octagon shape into a square shape under the weight of the poured concrete, as generally illustrated in FIG. 15E.

The square cross-section of FIG. 13D, the hexagon cross-section of FIG. 14D, and the octagon cross-section of FIG. 15 C are examples of regular polygons. A regular polygon is a polygon whose sides are all the same length, and whose angles are all the same. Such regular polygons, with an even number of sides of equal length sides, are able to be collapsed into a flat profile by making folds on opposing creases that form the angles of the polygon. Such regular polygons also provide aesthetically-pleasing symmetry above grade. However, the flat-forms may be designed with cross-sections that are not regular polygons. Such flat-forms may still be designed to expand into a circular or near circular cross section under the weight of the poured concrete.

According to an example, a concrete form may include a sleeve having a top edge and a bottom edge generally parallel to the top edge, wherein the top and bottom edges are in a lateral direction, the sleeve further having two or more parallel creases in a longitudinal direction. The sleeve may be configured to fold along at least two of the parallel creases to collapse into a flat profile, and be configured to be opened from the flat profile into a tubular structure for the concrete form. In some embodiments, the two or more parallel creases are an even number of creases equally spaced about the sleeve. In some embodiments, the sleeve includes severance lines, generally aligned with the parallel creases, extending from the bottom edge, wherein severance lines are configured to allow the sleeve to be separated into flat bottom panels to enable the flat bottom panels to flare outward at the bottom of the sleeve. In some embodiments the concrete form has approximately equal cross-sectional dimensions in orthogonal directions, such as is provided by cross-sections in the shape of a regular polygon. The sleeve may be formed from a solid fiber, liner board. The form may include a collar configured to be positioned around an exterior perimeter of the sleeve and to support the sleeve above grade, and may include an insert configured to be positioned in the sleeve and maintain the sleeve in an open position before concrete is formed into the sleeve.

According to an example, a method for forming concrete footing includes digging a hole for the concrete footing to a desired depth. Digging the hole may include digging the hole with dimensions generally corresponding to a column of the concrete footing; The method may further include opening a flattened sleeve into a concrete form, including flexing creases of the sleeve to provide an opened shape for the concrete form for use in forming the column of the concrete footing. The form is inserted into the hole and filled with concrete. A collar may be placed over the form and secured in position above grade. In some embodiments, the method may further include separating a bottom portion of the sleeve into bottom panels and flaring out a bottom of the hole for an expanded base of the concrete footing. Filling the form with concrete causes the bottom panels of the sleeve to flare out to form the expanded base of the concrete footing. In some embodiments, the bottom of the hole is flared out for an expanded base of the concrete footing, and the form is raised to allow concrete to flow in the bottom of the hole to form the expanded base.

The embodiments illustrated in this disclosure are not intended to be exclusive of other methods within the scope of the present subject matter. Those of ordinary skill in the art will understand, upon reading and comprehending this disclosure, other embodiments within the scope of the present subject matter. The above-identified embodiments, and portions of the illustrated embodiments, are not necessarily mutually exclusive. These embodiments, or portions thereof, can be combined.

The above detailed description is intended to be illustrative, and not restrictive. Other embodiments will be apparent to those of skill in the art upon reading and understanding the above description. The scope of the invention should, therefore, be determined with reference to the appended claims, along with the full scope of equivalents to which such claims are entitled.

What is claimed is:

1. A concrete form, comprising:

a sleeve having a top portion with a top edge and a bottom portion with a bottom edge generally parallel to the top edge, the bottom portion including a plurality of bottom severance lines extending from the bottom edge to the top portion, and the top portion including a plurality of top creases extending from the top edge to the bottom portion, wherein the top creases are generally perpendicular to the top and bottom edges;

wherein the top creases at least partially define a plurality of top panels around a periphery of the sleeve, and the bottom severance lines at least partially define a plurality of bottom panels configured to flare out when concrete is poured into the sleeve, and wherein the sleeve is formed using two or more solid fiber, liner boards adhered together using a water resistant glue.

* * * * *